US006375238B1

(12) United States Patent
Hopkins et al.

(10) Patent No.: US 6,375,238 B1
(45) Date of Patent: Apr. 23, 2002

(54) RAIL-HANGING PACKAGE FACING DEVICE

(76) Inventors: Anthony Hopkins, 7787 Beaver Head Rd., Ft. Worth, TX (US) 76137; Charlie Crow, 1204 Alicia Ann, Box 3, Wylie, TX (US) 75095; Susan Hopkins, 7787 Beaver Head Rd., Ft. Worth, TX (US) 76137

( * ) Notice: Subject to any disclaimer, the term of this patent is extended or adjusted under 35 U.S.C. 154(b) by 0 days.

(21) Appl. No.: 09/275,500

(22) Filed: Mar. 24, 1999

(51) Int. Cl.[7] ..... B25J 1/04
(52) U.S. Cl. ..... 294/24; 294/19.1; 294/26
(58) Field of Search ..... 294/1.1, 2, 3.6, 294/9–15, 19.1, 22–24, 26, 50.6, 55.5; 7/158, 161, 163, 164, 170; 15/236.01, 236.07, 236.08; 81/487, 488; 254/120, 131, 133 R

(56) References Cited

U.S. PATENT DOCUMENTS 533,776 A * 2/1895 Basnett ..... 294/23
1,111,893 A * 9/1914 Gadley ..... 294/22
1,308,654 A * 7/1919 Bopst ..... 7/164
1,339,444 A * 5/1920 Ferguson ..... 294/24
1,448,829 A * 3/1923 Clinton ..... 294/15
1,739,347 A * 12/1929 Benedict ..... 294/26
2,017,369 A * 10/1935 McGhee ..... 294/19.1 X
2,220,069 A * 11/1940 Farwig ..... 294/19.1 X
3,820,185 A * 6/1974 Phillips ..... 15/236.07 X
4,001,903 A * 1/1977 Hay ..... 7/164
D261,595 S * 11/1981 Yellin ..... 294/26 X
4,624,494 A * 11/1986 Huppert ..... 294/26
4,801,166 A * 1/1989 Jordan et al. ..... 294/24 X
5,217,272 A * 6/1993 Hsu et al. ..... 294/1.1
5,538,302 A * 7/1996 Travis ..... 294/24
5,826,925 A * 10/1998 Marx ..... 294/26 X

* cited by examiner

*Primary Examiner*—Johnny D. Cherry

(57) ABSTRACT

An article to move one or more packages that are slidable on a rail so that the front package is at the front of the peg rail and subsequent packages are one behind the other without significant unnecessary space. The article has a handle, a portion for engaging the peg rail and package so that upon movement forward of the engaging portion the package is brought forward, and a body portion connecting the handle and the portion for engaging the rail and package. The handle may include a lined scale for measuring distance, an orifice to facilitate hanging, and a box opener at one end.

4 Claims, 2 Drawing Sheets

RAIL-HANGING PACKAGE FACING DEVICE

FIELD OF THE INVENTION

The present invention relates to product displays and more particularly to a rail-hanging package facing device.

BACKGROUND OF THE INVENTION

One of the challenges retailers have is keeping a store looking like new. When customers go into a store they want to see a clean, well stocked store. One of the ways retailers strive to accomplish this is pulling merchandise forward as it sells or gets handled. A "wall" appearance is the goal; all items pulled as far forward as possible facing the customer. Retailers also want all merchandise on a peg or shelf pulled forward, not just the front few pieces. This process of bringing merchandise forward is called "facing". To face merchandise, a clerk must reach all the way to the back and bring everything forward. In some areas of the store this is easy, like diapers, paper towels and other bulky items. But as the items get smaller and closer together, the more difficult the job becomes. There are many areas of the store, in particular pegged areas, that it is almost physically impossible to get a hand between the product to accomplish this task. When it is attempted, the product usually falls off the peg and must be picked up and placed back on the right peg, wasting payroll. A good peg facing job can be done but it often takes a long time for it to be done right. Time is something of which most retailers do not have enough.

SUMMARY OF THE INVENTION

According, it is an object of the present invention to aide in pulling packaged merchandise hanging on a rail in a peg board or like system to the front of the rail.

It is an object of the present invention to reach between hanging packages on adjacent rails on a peg board or like hanging system to move at least the back most package.

It is another object of the invention to provide a device to quickly face a department having packages on a rail of a peg board or like system.

It is a further object of the invention to provide in the same device ability to perform related tasks such as box opening and distance measuring.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, an article to move one or more packages that are slidable on a rail such that the front package is at the front of the rail and subsequent packages are one behind the other without significant unnecessary space, the article compromises a handle, a means for engaging the rail and package so that upon movement forward of the engaging means, the package is brought forward, and a body portion connecting the handle and the means for engaging the rail and package.

BRIEF DESCRIPTION OF THE DRAWINGS

The drawings constitute a part of this specification and include exemplary embodiments of the invention, which may be embodied in various forms. It is to be understood that in some instances various aspects of the invention may be shown exaggerated or enlarged to facilitate an understanding of the invention.

DETAILED DESCRIPTION OF PREFERRED EMBODIMENT

Detailed description of the preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
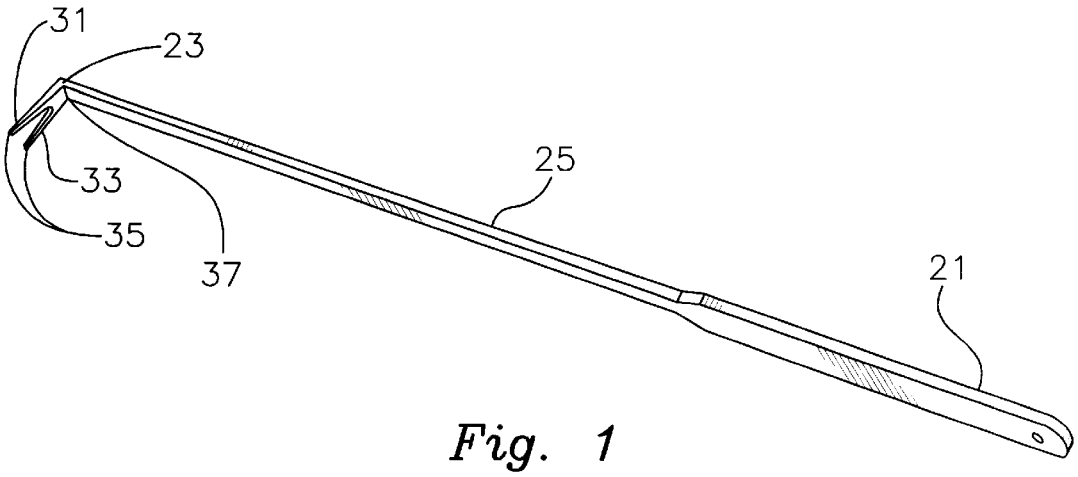
FIG. 1 is a perspective view of a rail-hanging package facing device in accordance with an embodiment of the invention.

Turning now to FIG. 1, there is shown a perspective view of a rail-hanging package facing device 10 in accordance with an embodiment of the invention. Facing device 10 in the illustrated embodiment has a handle 21 designed to be held and gripped by a user. Handle 21 is connected through body portion 25 to the rail engaging means 23.

In the embodiment shown at FIG. 1, handle 21 is substantially flat and elongatedly shaped, but may be of any of a large variety of shapes to facilitate a user to hold and grip facing device 10. Also in the embodiment shown, body portion 25 is illustrated as a narrowed section in relation to handle 21, but in not necessarily to perform the function of connecting handle 21 to rail engaging means 23. Body portion 25 should be sufficiently narrow, however, to fit between adjacent packages hanging on a rail system. It should also be noted that facing device 10 may be made of a variety of materials such as stainless steel, plastic, etc. or a combination of materials.

Figure 3:
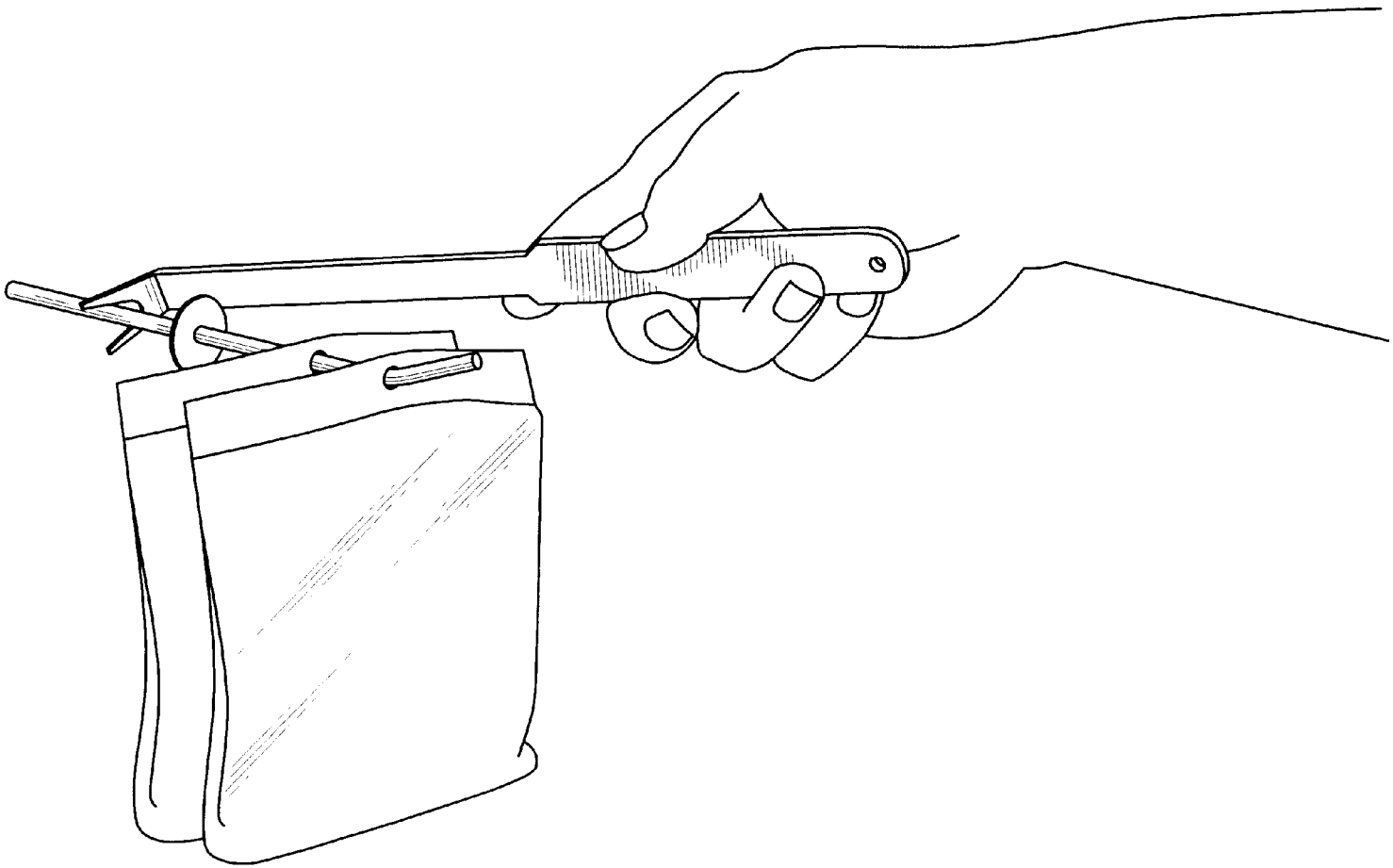
FIG. 3 is a close up, perspective view of a rail-hanging package facing device engaging a rail in accordance with an embodiment of the present invention.

Continuing with reference to FIG. 1, rail engaging means 23 in the illustrated embodiment is shown as two prongs 31, 33 extending from body portion 25 and separated to form area 35 designed to accommodate a rail of a variety of sizes such as shown in FIG. 3. Prongs 31, 33 are generally angled one away from the other so that when facing device 10 engages a rail at rail engaging means 23, the rail may first contact either prong 31 or prong 33 and be guided toward the body portion 25 for a more secure engagement.

In the preferred embodiment, rail engaging means 23 is angled from body portion 25 to facilitate rail engagement when facing device 10 is used between closely hanging packages. The degree of the angle may be different depending upon circumstances of intended use but is chosen as approximately 15 degrees past vertical as the body portion 25 is positioned horizontal.

The plastic facing device of FIG. 1 also has reinforcement 37 as additional plastic at areas of prongs 31, 33 of rail engaging means 23 for structured rigidity where prongs 31, 33 angle from body portion 25.

In order to reduce the overall size of facing device 10, facing device 10 may also be in multi-piece construction with a hinge or similar connecting device connecting the pieces, thus accommodating storage in a user's pocket or similar area. Further, in accordance with known techniques, facing device 10 may be equipped with a mylar or price tag remover at the tip of the handle. Facing device 10 may also be customized in appearance with company colors and/or a company logo printed or set in the handle 21.

Figure 2:
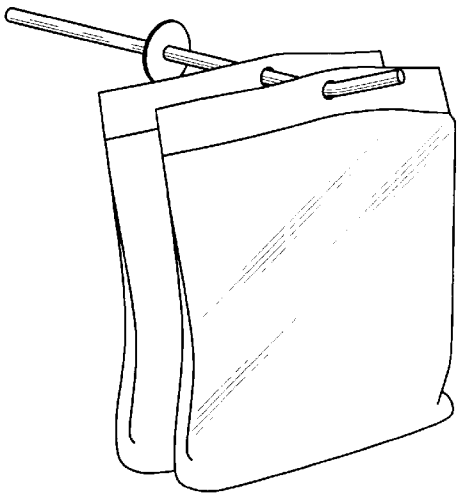
FIG. 2 is a perspective view of packages hanging on a rail or like system.

In operation, and as illustrated in FIGS. 2 and 3, a user typically would hold and grip facing device 10 at or about handle 21 and feed rail engaging means 23 by body portion 25 through adjacent packages hanging on adjacent rails. FIG. 2 shows a perspective view of packages hanging on a peg rail or like system. Such rails may be one on top of the other or side-to-side, or be the top most or side most in a series. In any case, rail engaging means 23 is then directed behind the back most package on the rail. On the illustrated form, FIG. 3 shows a close up, perspective view of a rail package facing device engaging a rail in accordance with an embodiment of the present invention. Prongs 31, 33 direct the rail towards body portion 25 for secure engagement. At that point, the user, maintaining engagement with the rail pulls facing device 10 by handle 21 toward the front of the rail. Such action causes rail engaging means 23 to bring the back-most package forward until it engages the next back-most package which is then also brought forward and so on until all packages on a rail are brought as far forward as possible with substantially no space between the packages remaining and the front-most package is substantially at the front of the rail.

In accordance with other aspects of the invention, facing device 10 also includes along handle 21 and body portion 25 a scale ruled portion so that the user may easily and quickly measure the distance between rails, packages, etc. Facing device 10 also includes along handle portion 21 a box opening device such as a blade to open boxes. There is also shown at FIG. 1 an orifice at handle 21 to facilitate hanging facing device 10 on a hook for storage.

While the invention has been described in connection with preferred embodiments, it will be understood that we do not intend to be limited to the particular embodiments shown but intend, on the contrary, to cover the various alternative and equivalent constructions included within the spirit and scope of the appended claims.

We claim:

1. An article to move one or more packages that are slidable on a rail so that the front package is at the front of the rail and subsequent packages are one behind the other without significant unnecessary space, the article comprising:

a handle;

a body portion having a longitudinal axis;

rail engaging means comprising two prongs generally angled one away from the other and both angled generally orthogonal to the body portion longitudinal axis for engaging the rail and package so that upon forward movement of the engaging means relative to the rail the package is brought forward; and the body portion connects the handle and the means for engaging the rail and package.

2. An article as claimed in claim 1 wherein the handle includes a lined scale for measuring distance.

3. An article as claimed in claim 1 wherein the handle includes an orifice to facilitate hanging.

4. An article as claimed in claim 1 wherein the article is made of a light weight plastic.

* * * * *